US012134453B2

(12) United States Patent
Hidaka

(10) Patent No.: US 12,134,453 B2
(45) Date of Patent: Nov. 5, 2024

(54) POD PROPULSION DEVICE

(71) Applicant: HONDA MOTOR CO., LTD., Tokyo (JP)

(72) Inventor: Yuichi Hidaka, Saitama (JP)

(73) Assignee: HONDA MOTOR CO., LTD., Tokyo (JP)

( * ) Notice: Subject to any disclaimer, the term of this patent is extended or adjusted under 35 U.S.C. 154(b) by 408 days.

(21) Appl. No.: 17/577,537

(22) Filed: Jan. 18, 2022

(65) Prior Publication Data

US 2022/0242543 A1 Aug. 4, 2022

(30) Foreign Application Priority Data

Jan. 29, 2021 (JP) ..... 2021-013565

(51) Int. Cl.
*B63H 21/38* (2006.01)
*B63H 1/20* (2006.01)
*B63H 21/17* (2006.01)

(52) U.S. Cl.
CPC ..... *B63H 21/38* (2013.01); *B63H 1/20* (2013.01); *B63H 21/17* (2013.01)

(58) Field of Classification Search
CPC ..... B63H 21/17; B63H 21/38; B63H 21/383; B63H 1/20; B63H 5/125; B63H 2005/1258
USPC ..... 440/6, 88
See application file for complete search history.

(56) References Cited

U.S. PATENT DOCUMENTS 6,994,602 B2 * 2/2006 Ries ..... H02K 3/47 440/51
7,061,147 B2 * 6/2006 Ries ..... H02K 1/185 310/52
7,186,156 B2 * 3/2007 Le Flem ..... H02K 9/12 440/6
7,448,929 B2 * 11/2008 Huber ..... H02K 5/20 440/88 C
10,336,430 B2 * 7/2019 Kosso ..... H02K 9/10

FOREIGN PATENT DOCUMENTS

JP 2005186748 A 7/2005

* cited by examiner

*Primary Examiner* — Daniel V Venne
(74) *Attorney, Agent, or Firm* — Armstrong Teasdale LLP

(57) ABSTRACT

A pod propulsion device includes: a pod configured to be disposed in water; a rotation shaft supported by the pod to be rotatable about a predetermined axis and having an end portion projecting out from the pod; a screw fixed to the end portion of the rotation shaft; an electric motor installed in the pod to rotationally drive the rotation shaft; multiple guide blades integrally formed on the pod to be arranged at intervals in a circumferential direction of the pod, each guide blade extending out radially from an outer surface of the pod; and a cooling circuit for cooling the electric motor, wherein the cooling circuit includes a cooling liquid passage formed to pass through an interior of at least one of the guide blades.

8 Claims, 4 Drawing Sheets

POD PROPULSION DEVICE

TECHNICAL FIELD

The present disclosure relates to a pod propulsion device configured to be disposed in water for propulsion of a watercraft.

BACKGROUND ART

There is known a pod type propeller (pod thruster) that is attached to the bottom of a watercraft via a strut and includes a pod having an electric motor therein and a propeller (screw) coupled to the output shaft of the electric motor (for example, see JP2005-186748A). In the pod thruster described in JP2005-186748A, to efficiently cool the electric motor contained in the pod, cooling oil is circulated through the interior of the pod so that the cooling oil cools the electric motor. The electric motor is cooled by being immersed in the cooling oil. The cooling oil is pressure fed from the cooling oil supply device disposed on the hull side and configuration is made such that the cooling oil circulates through the entirety of the interiors of the strut and the pod. The interior of the strut is divided by a recess into two parts in the output shaft direction such that one part functions as an outgoing passage and the other part functions as a return passage of the cooling oil.

However, though the pod propulsion device according to JP2005-186748A has a cooling oil passage provided in the pod to cool the pod, further improvement of the cooling efficiency is desired as the output of the electric motor increases.

SUMMARY OF THE INVENTION

In view of such background, a primary object of the present invention is to provide a pod propulsion device with an improved cooling efficiency.

To achieve such an object, one embodiment of the present invention provides a pod propulsion device (1) comprising: a pod (3) configured to be disposed in water; a rotation shaft (7) supported by the pod to be rotatable about a predetermined axis (3X) and having an end portion projecting out from the pod; a screw (4) fixed to the end portion of the rotation shaft; an electric motor (8) installed in the pod to rotationally drive the rotation shaft; multiple guide blades (6) integrally formed on the pod to be arranged at intervals in a circumferential direction of the pod, each guide blade extending out radially from an outer surface of the pod; and a cooling circuit (20) for cooling the electric motor, wherein the cooling circuit includes a cooling liquid passage (22) formed to pass through an interior of at least one of the guide blades.

According to this configuration, at least one of the guide blades is internally formed with a cooling liquid passage and thereby functions as a cooling fin. Therefore, compared to the case where the cooling liquid passage is provided only in the pod, the contact area between the cooling liquid and the surrounding water that thermally contact each other via the pod or the guide blade(s) becomes larger and the amount of heat dissipation increases accordingly, whereby the cooling efficiency improves. Note that as the travel speed of the watercraft increases, the load of the electric motor increases and the amount of heat generation from the electric motor also increases, but since the flow speed of water passing around the guide blades also increases, the heat transfer rate between the water and the guide blades becomes greater. This also contributes to the improvement of the cooling efficiency.

Preferably, the cooling liquid passage is formed to pass through the interiors of more than one of the multiple guide blades.

According to this configuration, compared to the case where the cooling liquid passage is formed to pass through the interior of only a single guide blade, the contact area between the cooling liquid and the surrounding water that thermally contact each other via the guide blades becomes larger, whereby the cooling efficiency improves further.

Preferably, the cooling liquid passage is formed to pass through the interiors of all of the guide blades.

According to this configuration, compared to the case where the cooling liquid passage is formed not to pass through at least one of the guide blades, the contact area between the cooling liquid and the surrounding water that thermally contact each other via the guide blades becomes larger, whereby the cooling efficiency improves further.

Preferably, a partition wall (29) is provided in the interior of the at least one of the guide blades, and the cooling liquid passage is divided by the partition wall into a radial outgoing part (27A) through which the cooling liquid flows radially outward and a radial return part (27B) through which the cooling liquid flows radially inward.

According to this configuration, it is possible to reliably make the cooling liquid flow through the interior of the at least one of the guide blades and to transfer the heat of the cooling liquid to the surrounding water via the guide blade(s).

Preferably, the cooling liquid passage is formed to pass through the interiors of more than one of the guide blades, and the cooling liquid passage includes a circumferential passage (28) provided in the pod such that the circumferential passage extends in the circumferential direction about the axis of the pod to connect the radial return part of one of two of the guide blades with the radial outgoing part of another of the two of the guide blades.

According to this configuration, it is possible to circulate the cooling liquid by connecting an electric motor-side, which is the heat receiving part of the cooling liquid passage, with the internal part of at least two of the guide blades, which constitute the heat dissipation part. Accordingly, since there is no need to connect the electric motor side of the cooling liquid passage with the internal part of each of the guide blades, the configuration of the cooling liquid passage is simple.

Preferably, the cooling liquid passage is formed to pass through the interiors of at least three of the guide blades, and the circumferential passage (28A, 28B) is provided at two different positions in an axial direction of the pod.

According to this configuration, it is possible to connect the internal parts of all of the three or more guide blades in which the cooling liquid passage passes by using the circumferential passages provided at two different positions in the axial direction. Thereby, the cooling liquid passage is required to have only two connection parts to connect the electric motor side (the heat receiving part of the cooling liquid passage) with the guide blade side (the heat dissipation part), and thus, the configuration of the cooling liquid passage is simple.

Preferably, the cooling circuit includes a pump (21) driven by the rotation shaft, and the cooling liquid passage is formed only in an interior of the pod and the interior of the at least one of the guide blades.

According to this configuration, it is unnecessary to form the cooling liquid passage in the strut supporting the pod or the hull to which the strut is attached, and therefore, the configuration of the cooling circuit is simple.

Preferably, the screw is disposed behind the pod, the guide blades are disposed in front of and adjacent to the screw, and each of the guide blades is twisted in a same direction as screw blades (5) of the screw.

According to this configuration, the water flow toward the screw is guided by the guide blades in the direction opposite to the rotation direction of the screw, and the inflow angle of water onto the screw is restricted. Thereby, even when the travel speed of the watercraft increases, the inflow angle of water onto the screw does not become large and the reduction in the thrust (propulsion force) due to generation of vortices can be suppressed.

According to the present invention, a pod propulsion device with an improved cooling efficiency can be provided.

DESCRIPTION OF THE PREFERRED EMBODIMENT(S)

In the following, an embodiment of the present invention will be described in detail with reference to the drawings.

Figure 1:
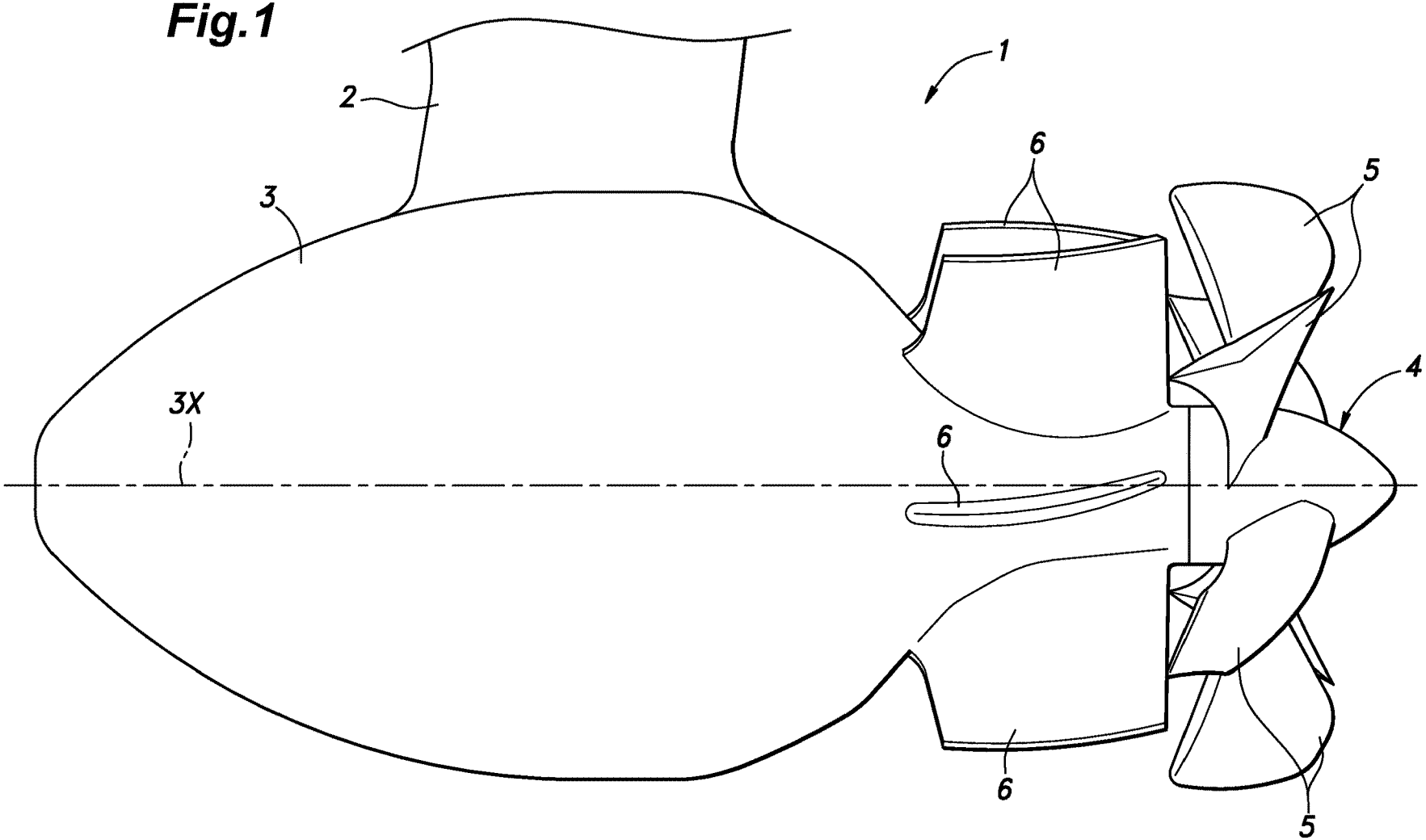
FIG. 1 is a side view of a pod propulsion device according to an embodiment of the present invention.

FIG. 1 is a side view of a pod propulsion device 1 according to the embodiment. As shown in FIG. 1, the pod propulsion device 1 is supported below the bottom of the watercraft by a strut 2 attached to the bottom of the watercraft to be rotatable about a vertical axis. The pod propulsion device 1 includes a pod 3 having a predetermined axis 3X extending in water in a substantially horizontal direction and a screw 4 supported by the pod 3 to be rotatable about the axis 3X of the pod 3. The screw 4 is disposed on the rear side (right end in FIG. 1) of the pod 3 with respect to the propulsion direction (leftward direction in FIG. 1). The fore and aft direction is defined with respect to the propulsion direction of the pod 3.

The screw 4 is provided with six screw blades 5 arranged evenly in the circumferential direction (at an interval of 60 degrees). Each screw blade 5 is twisted clockwise as seen from the rear as it extends toward the rear. When rotated counterclockwise as seen from the rear, the screw 4 provides rearward acceleration to the water and receives reaction force from the water to generate thrust.

In a rear portion of the pod 3 adjacent to the screw 4, multiple guide blades 6 are integrally formed on the pod 3 to be arranged at intervals in the circumferential direction of the pod 3 such that each guide blade 6 extends out radially from the outer surface of the pod 3. In the present embodiment, six guide blades 6 are arranged evenly in the circumferential direction (at an interval of 60 degrees). Each guide blade 6 is gradually twisted, from the direction parallel to the propulsion direction, clockwise as seen from the rear as it extends toward the rear, or twisted in the same direction as the screw blades 5.

Therefore, the water flow from the front toward the screw 4 is guided by each guide blade 6 in the direction opposite to the rotation direction of the screw 4, and this restricts the inflow angle of water onto the screw 4. In the case where the guide blades 6 are absent, as the rotation speed of the screw 4 increases, the inflow angle of water onto the screw 4 increases in the screw rotation direction. As a result, vortices are generated in the water pushed out rearward by the screw 4, and this hinders efficient production of thrust. In contrast, in the present embodiment, since the guide blades 6 having the above-described configuration are provided, even when the travel speed of the watercraft increases, the inflow angle of water onto the screw 4 does not become large and the reduction in the thrust due to generation of vortices can be suppressed.

Figure 2:
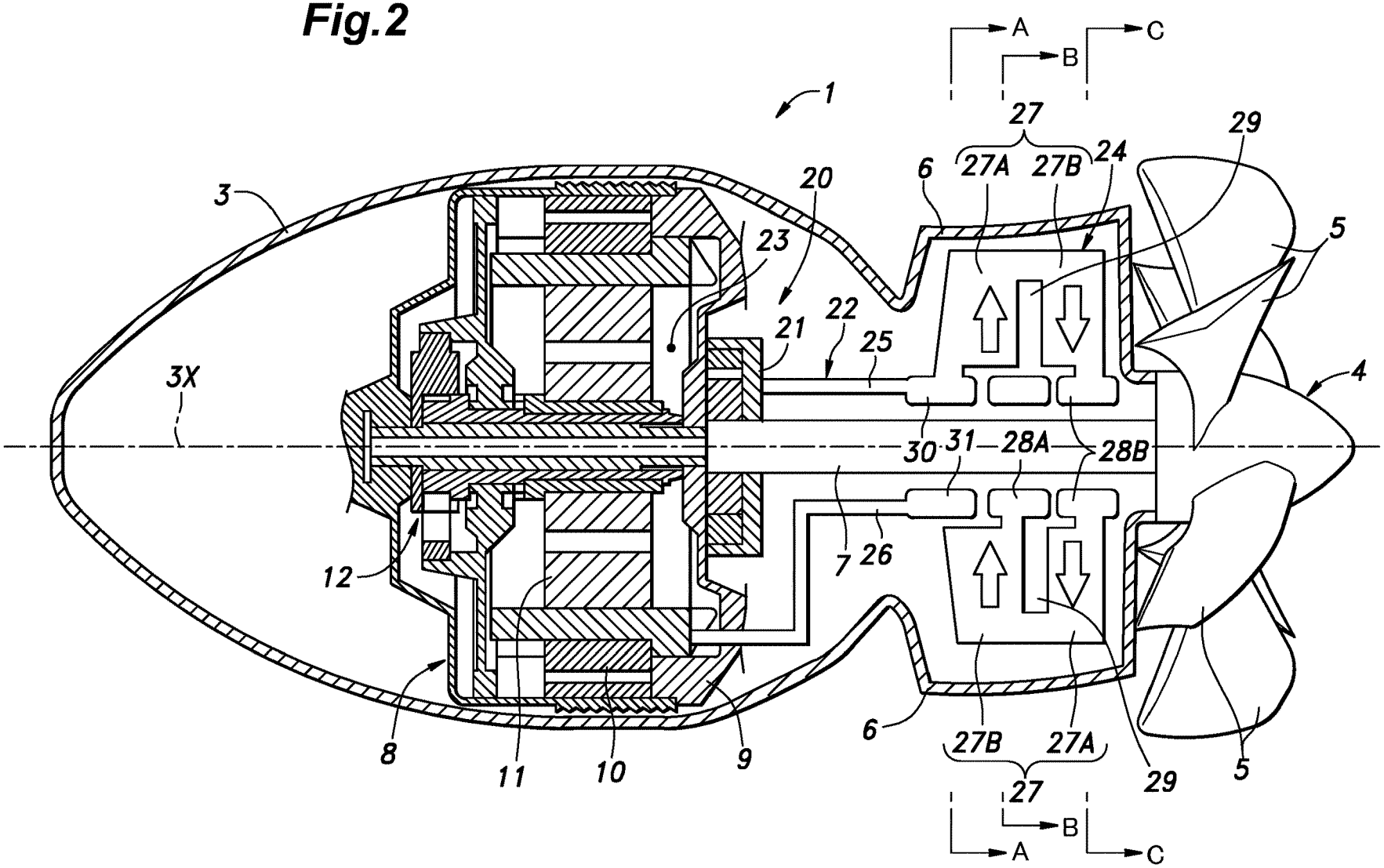
FIG. 2 is a sectional view taken along a plane passing through an axis of the pod propulsion device shown in FIG. 1.
Figure 3:
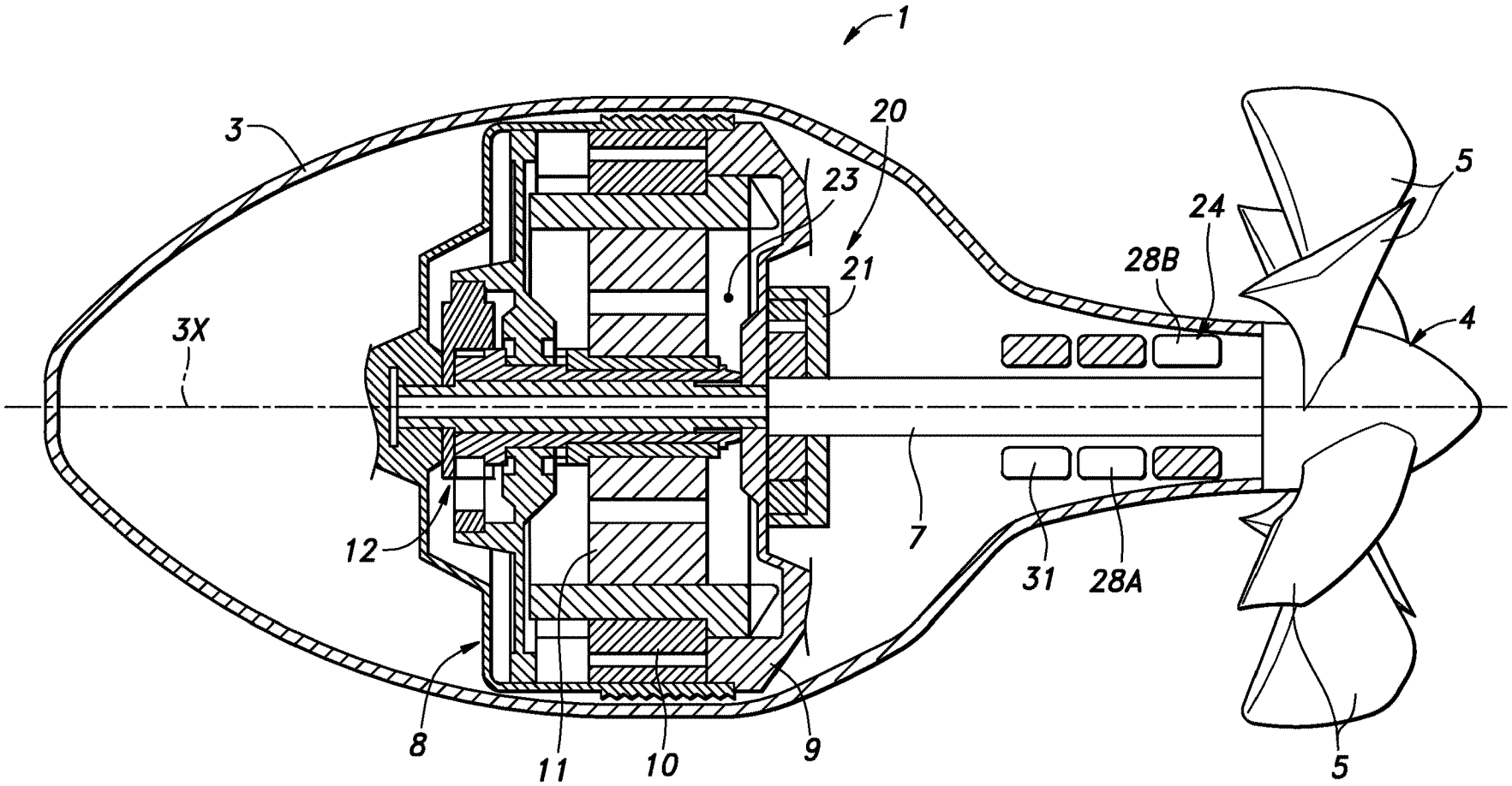
FIG. 3 is a sectional view taken along a plane passing through the axis of the pod propulsion device shown in FIG. 1 at a different angle.
Figures 4A, 4B, 4C:
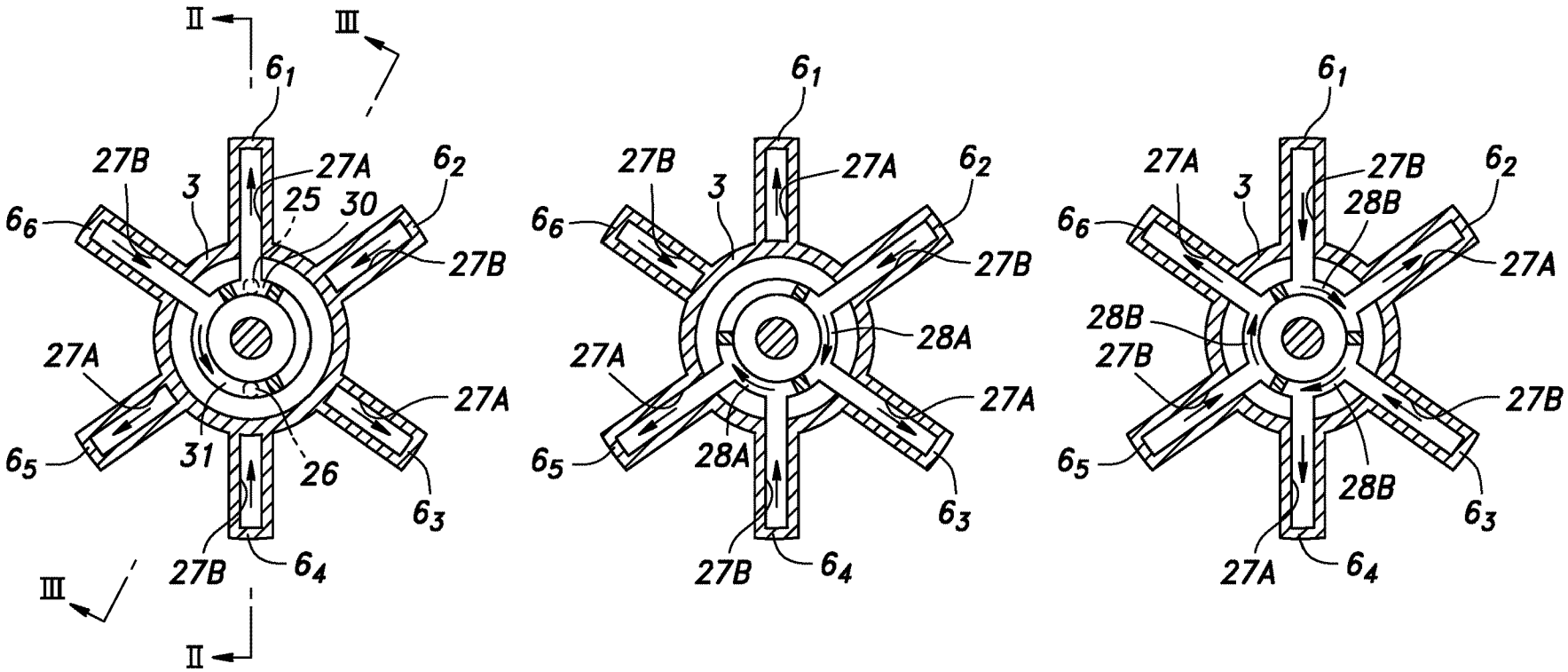
FIG. 4A is a sectional view taken along line A-A in FIG. 2.
FIG. 4B is a sectional view taken along line B-B in FIG. 2.
FIG. 4C is a sectional view taken along line C-C in FIG. 2.

FIG. 2 is a sectional view taken along a plane passing through the axis 3X of the pod propulsion device 1 shown in FIG. 1, and FIG. 3 is sectional view taken along a plane passing through the axis 3X of the pod propulsion device 1 shown in FIG. 1 at a different angle. Note that FIG. 2 is a sectional view taken along line II-II in FIG. 4A and FIG. 3 is a sectional view taken along line in FIG. 4A. As shown in FIG. 2 and FIG. 3, a rotation shaft 7 is disposed on the axis 3X of the pod 3. The rotation shaft 7 is supported by the pod 3 via a bearing not shown in the drawings so as to be rotatable about the axis 3X.

The pod 3 contains an electric motor 8 for rotationally driving the rotation shaft 7. The electric motor 8 is disposed in an intermediate portion of the pod 3 in the axial direction (fore and aft direction). The electric motor 8 includes a case 9 supported by the pod 3, a cylindrical stator 10 disposed inside the case 9, and a rotor 11 disposed to define a gap on an inner side of the stator 10. The rotation shaft 7 is coupled to the rotor 11 via a reducer 12 including a planetary gear mechanism, and rotates at a speed lower than that of the rotor 11. In another embodiment, the rotation shaft 7 may be fixed to the rotor 11 to constitute the output shaft of the electric motor 8, so that the rotation shaft 7 rotates at the same speed as the rotor 11. The rotation shaft 7 extends rearward through the case 9 and further extends rearward from the case 9 to project out from the rear end of the pod 3. The screw 4 is fixed to the rear end portion of the rotation shaft 7 projecting out rearward from the pod 3.

A cooling circuit 20 for cooling the electric motor 8 is provided inside the pod 3. The cooling circuit 20 includes an oil pump 21 that pressure feeds cooling oil as coolant and a cooling oil passage 22 through which the cooling oil pressure fed by the oil pump 21 flows. The oil pump 21 is integrally provided on the case 9 at the rear portion of the electric motor 8 and is rotationally driven by the electric motor 8. The oil pump 21 may be a trochoid pump that includes an inner rotor fixed to the rotation shaft 7 and an outer rotor having an inner periphery coming into contact with the inner rotor and discharges the cooling oil upon rotation of the rotor 11. In another embodiment, the oil pump 21 may be a pump of another type such as an external gear pump, a vane pump, etc.

The cooling oil passage 22 includes a heat receiving part 23, which is in an interior of the case 9 of the electric motor 8 and in which the cooling oil receives heat from the electric motor 8, and a heat dissipation part 24 in which the cooling oil having received heat at the heat receiving part 23 releases the heat to the outside. The cooling oil passage 22 forms a loop to circulate the cooling oil. The heat dissipation part 24 is formed in the rear end portion of the pod 3 at which the multiple guide blades 6 are formed. The heat receiving part 23 and the heat dissipation part 24 communicate with each other via an axial outgoing part 25 and an axial return part 26 each extending in the axial direction of the pod 3. The axial outgoing part 25 guides the cooling oil from the heat receiving part 23 to the heat dissipation part 24. The axial return part 26 guides the cooling oil from the heat dissipation part 24 to the heat receiving part 23. The oil pump 21 may be provided on the axial outgoing part 25 or the axial return part 26. In the present embodiment, the oil pump 21 is provided on the axial outgoing part 25.

The heat dissipation part 24 is formed to pass through an interior of each guide blade 6. Specifically, the heat dissipation part 24 includes a radial passage 27 (27A, 27B) formed in the interior of each guide blade 6 and a circumferential passage 28 (28A, 28B) provided in the pod 3 to extend in the circumferential direction about the axis 3X of the pod 3 as shown in FIG. 3. Each guide blade 6 internally formed with the radial passages 27 of the cooling oil passage 22 functions as a cooling fin. The circumferential passage 28 connects the radial passages 27 formed in the interiors of circumferentially adjoining two guide blades 6 to each other.

A partition wall 29 is provided in the interior of each guide blade 6, and each radial passage 27 is divided by the corresponding partition wall 29 into a radial outgoing part 27A through which the cooling oil flows radially outward and a radial return part 27B through which the cooling oil flows radially inward. The circumferential passage 28 includes a front circumferential passage 28A and a rear circumferential passage 28B provided at mutually different positions with respect to the axial direction of the pod 3. The front circumferential passage 28A and the rear circumferential passage 28B are each divided into multiple parts in the circumferential direction (see FIGS. 4A to 4C).

The axial outgoing part 25 is in communication with the radial outgoing part 27A formed in one of the guide blades 6 via a cooling oil introduction part 30. The axial return part 26 is in communication with the radial return part 27B formed in another one of the guide blades 6 via a cooling oil output part 31.

FIGS. 4A, 4B, and 4C are sectional views taken along lines A-A, B-B, and C-C in FIG. 2, respectively. In the following, for convenience of explanation, the six guide blades 6 will be referred to as the first guide blade $\mathbf{6}_1$ to the sixth guide blade $\mathbf{6}_6$ in clockwise order. As shown in FIG. 4A, the cooling oil introduction part 30 connects the axial outgoing part 25, which is formed at a position corresponding to the first guide blade $\mathbf{6}_1$ in the circumferential direction, with the radial outgoing part 27A of the first guide blade $\mathbf{6}_1$. The cooling oil output part 31 extends circumferentially to connect the axial return part 26, which is formed at a position corresponding to the fourth guide blade $\mathbf{6}_4$ in the circumferential direction, with the radial return part 27B of the sixth guide blade $\mathbf{6}_6$. The cooling oil introduction part 30 may extend in the circumferential direction similarly to the cooling oil output part 31. Also, the cooling oil output part 31 does not necessarily have to extend in the circumferential direction similarly to the cooling oil introduction part 30.

The radial return part 27B of the first guide blade $\mathbf{6}_1$ is in communication with the radial outgoing part 27A of the second guide blade $\mathbf{6}_2$ via a part of the rear circumferential passage 28B, as shown in FIG. 4C. The radial return part 27B of the second guide blade $\mathbf{6}_2$ is in communication with the radial outgoing part 27A of the third guide blade $\mathbf{6}_3$ via a part of the front circumferential passage 28A, as shown in FIG. 4B. The radial return part 27B of the third guide blade $\mathbf{6}_3$ is in communication with the radial outgoing part 27A of the fourth guide blade $\mathbf{6}_4$ via a part of the rear circumferential passage 28B, as shown in FIG. 4C. The radial return part 27B of the fourth guide blade $\mathbf{6}_4$ is in communication with the radial outgoing part 27A of the fifth guide blade $\mathbf{6}_5$ via another part of the front circumferential passage 28A, as shown in FIG. 4B. The radial return part 27B of the fifth guide blade $\mathbf{6}_5$ is in communication with the radial outgoing part 27A of the sixth guide blade $\mathbf{6}_6$ via yet another part of the rear circumferential passage 28B, as shown in FIG. 4C. The radial return part 27B of the sixth guide blade $\mathbf{6}_6$ is in communication with the axial return part 26 (FIG. 2) which is formed at a position corresponding to the fourth guide blade $\mathbf{6}_4$, via the cooling oil output part 31, as shown in FIG. 4A.

Thus, the cooling oil passage 22 is formed as a single circulation passage. In another embodiment, the axial outgoing part 25 may be divided into two or more parts, and the cooling oil passage 22 may be formed as a circulation passage having two or more parallel passage parts in the heat dissipation part 24.

As described above, the cooling circuit 20 includes the cooling oil passage 22 formed to pass through the interior of at least one of the guide blades 6. Therefore, compared to the case where the cooling oil passage 22 is provided only in the pod 3, the contact area between the cooling oil and the surrounding water that thermally contact each other via the pod 3 or the guide blade(s) 6 becomes larger and the amount of heat dissipation increases accordingly, whereby the cooling efficiency improves. Note that as the travel speed of the watercraft increases, the load of the electric motor 8 increases and the amount of heat generation from the electric motor 8 also increases, but since the flow speed of water passing around the guide blades 6 also increases, the heat transfer rate between the water and the guide blades 6 becomes greater. This also contributes to the improvement of the cooling efficiency.

In the present embodiment, the cooling oil passage 22 is formed to pass through the interiors of more than one of the interior of the guide blades 6. Therefore, compared to the case where the cooling oil passage 22 is formed to pass through the interior of only a single guide blade 6, the contact area between the cooling oil and the surrounding water that thermally contact each other via the guide blades 6 becomes larger, whereby the cooling efficiency improves further.

Also, in the present embodiment, the cooling oil passage 22 is formed to pass through the interiors of all of the guide blades 6. Therefore, compared to the case where the cooling oil passage 22 is formed not to pass through at least one of the guide blades 6, the contact area between the cooling oil and the surrounding water that thermally contact each other via the guide blades 6 becomes larger, whereby the cooling efficiency improves further.

As described above, in the interior of each guide blade 6, a partition wall 29 is provided and the cooling oil passage 22 is divided by the partition wall 29 into the radial outgoing part 27A, through which the cooling oil flows radially outward, and the radial return part 27B, through which the cooling oil flows radially inward. Therefore, it is ensured that the cooling oil flows through the radial passages 27 in the guide blades 6 and the heat of the cooling oil is transferred to the surrounding water via the guide blades 6.

In the present embodiment, the cooling oil passage 22 is formed to pass through the interiors of more than one of the guide blades 6. In addition, as shown in FIGS. 4A to 4C, the cooling oil passage 22 includes the circumferential passage 28 that extends in the circumferential direction about the axis 3X of the pod 3 to connect the radial return part 27B of one of two of the guide blades 6 with the radial outgoing part 27A of the other of the two of the guide blades 6. Therefore, it is possible to circulate the cooling oil by connecting the interior of the electric motor 8, which is the heat receiving part 23 of the cooling oil passage 22, with the radial passages 27 of at least two of the guide blades 6, which constitute the heat dissipation part 24. Accordingly, since there is no need to connect the interior of the electric motor 8 with the radial passage 27 of each of the guide blades 6, the configuration of the cooling oil passage 22 is simple.

Further, in the present embodiment, the cooling oil passage 22 is formed to pass through the interiors of at least three of the guide blades 6. In addition, as shown in FIGS. 2 and 3, the circumferential passage 28 (28A, 28B) is provided at two different positions in the axial direction of the pod 3. Therefore, as also shown in FIGS. 4A to 4C, it is possible to connect the radial passages 27 of all of the guide blades 6 by using the circumferential passages 28 (28A, 28B). Thereby, as shown in FIG. 2, only two connection parts, namely, the axial outgoing part 25 and the axial return part 26, are sufficient to connect the interior of the electric motor 8, which is the heat receiving part 23 of the cooling oil passage 22, with the radial passages 27 of the guide blades 6, which constitute the heat dissipation part 24, and thus, the configuration of the cooling oil passage 22 is simple.

The cooling circuit 20 includes the oil pump 21 driven by the rotation shaft 7, and the cooling oil passage 22 is formed in the interiors of the pod 3 and the guide blades 6. Therefore, it is unnecessary to form the cooling oil passage 22 in the strut 2 supporting the pod 3 or the hull to which the strut 2 is attached. Therefore, the configuration of the cooling circuit 20 is simple.

A concrete embodiment of the present invention has been described in the foregoing, but the present invention is not limited to the above embodiment and may be modified or altered in various ways. For example, in the above embodiment, the screw 4 is disposed behind the pod 3 but the screw 4 may be disposed in front of the pod 3. Also, in the above embodiment, the multiple guide blades 6 are provided on the rear end portion of the pod 3 adjacent to and in front of the screw 4, but the guide blades 6 may be provided on a front end side opposite from the screw 4 or behind the screw. Also, the cooling liquid is not limited to oil and may be any appropriate cooling liquid. Thus, the cooling oil passage 22 of the cooling circuit 20 is an example of a cooling liquid passage. Besides, the concrete structure, arrangement, number, angle, etc. of each member or part may be appropriately changed within the scope of the present invention.

Also, not all of the components shown in the foregoing embodiment are necessarily indispensable and they may be selectively adopted as appropriate.

The invention claimed is:

1. A pod propulsion device comprising:

a pod configured to be disposed in water;

a rotation shaft rotatably supported by the pod to be, the rotation shaft being rotatable about a predetermined axis and having an end portion projecting out from the pod;

a screw fixed to the end portion of the rotation shaft;

an electric motor installed in the pod to rotationally drive the rotation shaft;

multiple guide blades integrally formed on the pod and to be arranged at intervals in a circumferential direction of the pod, each guide blade extending out radially from an outer surface of the pod; and a cooling circuit for cooling the electric motor, wherein the cooling circuit includes a cooling liquid passage formed to pass through an interior of at least one of the guide blades.

2. The pod propulsion device according to claim 1, wherein the cooling liquid passage is formed to pass through the interiors of more than one of the guide blades.

3. The pod propulsion device according to claim 2, wherein the cooling liquid passage is formed to pass through the interiors of all of the guide blades.

4. The pod propulsion device according to claim 1, wherein a partition wall is provided in the interior of the at least one of the guide blades, and the cooling liquid passage is divided by the partition wall into a radial outgoing part through which the cooling liquid flows radially outward and a radial return part through which the cooling liquid flows radially inward.

5. The pod propulsion device according to claim 4, wherein the cooling liquid passage is formed to pass through the interiors of more than one of the guide blades, and the cooling liquid passage includes a circumferential passage provided in the pod such that that the cooling liquid passage extends in the circumferential direction about the axis of the pod to connect the radial return part of one of two of the guide blades with the radial outgoing part of another of the two of the guide blades.

6. The pod propulsion device according to claim 5, wherein the cooling liquid passage is formed to pass through the interiors of at least three of the guide blades, and the circumferential passage is provided at two different positions in an axial direction of the pod.

7. The pod propulsion device according to claim 1, wherein the cooling circuit includes a pump driven by the rotation shaft, and the cooling liquid passage is formed only in an interior of the pod and the interior of the at least one of the guide blades.

8. The pod propulsion device according to claim 1, wherein the screw is disposed behind the pod, the guide blades are disposed in front of and adjacent to the screw, and each of the guide blades is twisted in a same direction as screw blades of the screw.

* * * * *